US010720130B2

(12) United States Patent
Shenhar et al.

(10) Patent No.: US 10,720,130 B2
(45) Date of Patent: Jul. 21, 2020

(54) TUNABLE DRUM

(71) Applicant: ZIKIT DRUMS LTD., Ra'anana (IL)

(72) Inventors: Oz Shenhar, Ra'anana (IL); Boaz Ken Dror, Tel Aviv (IL); Nir Barkai, Kfar Saba (IL)

(73) Assignee: ZIKIT DRUMS LTD., Ra'anana (IL)

( * ) Notice: Subject to any disclaimer, the term of this patent is extended or adjusted under 35 U.S.C. 154(b) by 0 days.

(21) Appl. No.: 16/301,267

(22) PCT Filed: May 11, 2017

(86) PCT No.: PCT/IL2017/050525
§ 371 (c)(1),
(2) Date: Nov. 13, 2018

(87) PCT Pub. No.: WO2017/195207
PCT Pub. Date: Nov. 16, 2017

(65) Prior Publication Data

US 2019/0213982 A1 Jul. 11, 2019

(30) Foreign Application Priority Data

May 12, 2016 (IE) ..... 245630

(51) Int. Cl.
*G10D 13/02* (2020.01)
*G10D 13/16* (2020.01)

(52) U.S. Cl.
CPC ..... *G10D 13/02* (2013.01); *G10D 13/16* (2020.02)

(58) Field of Classification Search
CPC ..... G10D 13/023
See application file for complete search history.

(56) References Cited

U.S. PATENT DOCUMENTS

| | | | |
|---|---|---|---|
| 1,901,765 | A | 3/1933 | Newberry |
| 2,051,671 | A | 8/1936 | Au-Miller |
| 2,546,452 | A | 3/1951 | Kmieliauskas |
| 4,079,657 | A | 3/1978 | Sobreira |
| 4,211,144 | A | 7/1980 | May |
| 4,519,289 | A | 5/1985 | Gauger |
| 4,616,551 | A | 10/1986 | Bookvich |
| 4,909,125 | A | 3/1990 | Fece |
| 7,291,776 | B2 | 11/2007 | Dunnett |

(Continued)

FOREIGN PATENT DOCUMENTS

| | | | |
|---|---|---|---|
| CN | 102831878 | A | 12/2012 |
| CN | 204189431 | U | 3/2015 |

(Continued)

*Primary Examiner* — Kimberly R Lockett
(74) *Attorney, Agent, or Firm* — William Dippert; Laurence Greenberg; Werner Stemer

(57) ABSTRACT

Aspects of embodiments concerns an apparatus for tuning a drum, the drum comprising a drum shell having an upper skin, the apparatus comprising: an outer static rim that is removably operably coupleable to the inside wall of a drum shell; a diameter adjustment mechanism that is removably operably coupleable with the drum shell, the diameter adjustment mechanism including one or more inner cylindrical shells mountable within the drum shell and being configured for axial displacement whereby an upper rim thereof can be selectively brought into or out of contact with an upper skin of the drum and thereby change an effective diameter of the upper skin.

17 Claims, 12 Drawing Sheets

(56) References Cited

U.S. PATENT DOCUMENTS

| | | | |
|---|---|---|---|
| 7,781,659 | B2 | 8/2010 | Liao |
| 7,781,661 | B2 | 8/2010 | Rogers et al. |
| 7,888,574 | B1 | 2/2011 | Acoutin |
| 7,888,575 | B1 | 2/2011 | Toscano |
| 8,203,062 | B2 | 6/2012 | Case et al. |
| 8,912,416 | B2 | 12/2014 | Spinazzola |
| 9,224,371 | B1 | 12/2015 | Wu et al. |
| 2009/0308225 | A1 | 12/2009 | Natali |

FOREIGN PATENT DOCUMENTS

| | | | | |
|---|---|---|---|---|
| CN | 207818171 U | * | 9/2018 | ..... G10D 13/02 |
| EP | 0044626 A2 | | 1/1982 | |
| GB | 678827 | | 9/1952 | |

* cited by examiner

SECTION A-A

SECTION A-A

TUNABLE DRUM

CROSS-REFERENCE TO RELATED APPLICATIONS

The present application is a National Phase filing under 35 U.S.C. § 371 of International Patent Application No. PCT/IL2017/050525, filed May 11, 2017, which is based upon and claims the benefit of the priority date of Israeli Patent Application No. 245630, filed May 12, 2016, titled "Universal Tunable Drum," each of which is expressly incorporated herein by reference in its entirety.

TECHNICAL FIELD

The present disclosure relates to musical instruments and, more specifically, to drums and methods for use thereof.

BACKGROUND

In all their varied forms, a drum is essentially a cylindrical sound box formed of rigid material on which there is stretched a skin, which when hit, induces in the sound box a vibration having a frequency that is characteristic inter alia of the depth and diameter of the sound box. Therefore, in order to produce different frequencies, multiple drums are required each tuned to a specific frequency. This is why drum kits typically comprise at least three different drums all tuned to different frequencies.

The frequency to which drums are tuned depends among other factors to the type of music for which they are intended. Consequently, a band that plays both rock-and-roll as well as classical or folk music has generally been obliged to equip itself with multiple drum kits. This requirement increases capital and storage as well as maintenance costs. References considered to be relevant as background to the presently disclosed subject matter are listed below:

[1] US2005120863
[2] CN102831878
[3] U.S. Pat. No. 4,211,144
[4] U.S. Pat. No. 4,909,125A
[5] GB678827A
[6] U.S. Pat. No. 7,888,574
[7] U.S. Pat. No. 7,888,575
[8] US2009308226
[9] U.S. Pat. No. 9,224,371
[10] CN204189431U
[11] US2014026732
[12] US2010218662
[13] EP 0 044 626

Acknowledgement of the above references herein is not to be inferred as meaning that these are in any relevant to the patentability of the presently disclosed subject matter. The description above is presented as a general overview of related art in this field and should not be construed as an admission that any of the information it contains constitutes prior art against the present patent application.

Overview

One object of the invention can be considered to provide a drum comprising a mechanism that allows adjusting at least one audio characteristic of the drum.

Example 1 concerns an apparatus for tuning a drum, the drum comprising a drum shell having an upper skin, the apparatus comprising: an outer static rim that is removably operably coupleable to the inside wall of a drum shell; a diameter adjustment mechanism that is removably operably coupleable with the drum shell, the diameter adjustment mechanism including one or more inner cylindrical shells mountable within the drum shell and being configured for axial displacement whereby an upper rim thereof can be selectively brought into or out of contact with an upper skin of the drum and thereby change an effective diameter of the upper skin.

Example 2 includes the subject matter of example 1 and, optionally, wherein the outer static rim and the diameter adjustment mechanism are removably operably coupleable with the drum by a fastening mechanism comprising one or more of the following: snap-fits and/or clamps.

Example 3 includes a tunable drum comprising an outer cylindrical shell defining a hollow housing having opposing open lower and upper ends, a lower and upper skin each covering a respective one of the lower and upper ends, and a diameter adjustment mechanism inside the hollow housing and fixedly attached to an inner surface of the shell, the mechanism including at least one inner cylindrical shell mounted within the outer cylindrical shell and being configured for axial displacement whereby an upper rim thereof may be brought into or out of contact with the upper skin and thereby change an effective diameter of the upper skin.

Example 4 includes the subject matter of example 3 and, optionally, wherein the diameter adjustment mechanism includes: a circular base supporting at least one ramp for each annular shell, the ramp being rotatable relative to the outer cylindrical shell of the drum and being dimensioned such that when a lower rim of the respective inner cylindrical shell is supported at an upper end of the ramp, the upper rim abuts the upper skin and when the lower rim of the respective inner cylindrical shell is supported at a lower end of the ramp, the upper rim is clear of the upper skin, a linear bevel gear mounted toward a periphery of the circular base, and a pinion gear rotatably mounted toward the lower end of the cylindrical shell for engaging the linear bevel gear; wherein rotation of the pinion gear in a first direction rotates the circular base in a first direction and causes the ramp to push the annular shell upward, while rotation of the pinion gear in a second opposite direction rotates the base in a second opposite direction, thereby lowering the ramp and allowing the annular shell to fall clear of the upper skin.

Example 5 includes the subject matter of example 4 and, optionally, wherein the circular base supports at least two radially displaced ramps mounted in anti-phase and each supporting a respective annular shell.

Example 6 includes the subject matter of examples 4 or 5 and, optionally, wherein each of the ramps comprises a longitudinal slot through there is mounted a sliding coupler bolt having a lower end and an upper end, the upper end being configured for coupling to the respective annular shell and the lower end supporting a mechanical energy storage device abutting a lower surface of the ramp so as to urge the coupler bolt toward the lower end of the ramp.

Example 7 includes the subject matter of example 6 and, optionally, wherein the upper end of the coupler bolt is attached to a key that engages a slot in a lower periphery of the annular shell.

Example 8 includes the subject matter of any one of the examples 4 to 7 and, optionally, wherein the pinion gear is operated by a lever having a releasable stopper that rotates relative to a dial having a projecting edge that arrests further rotation of the lever.

Example 9 includes the subject matter of example 8 and, optionally, wherein the dial is rotatable by a worm gear so that the height of the upper rim is finely adjustable and predictable.

Example 10 includes the subject matter of any one of the examples 3 to 9 and, optionally, wherein the cylindrical shells are levelled so that their upper rims are parallel to the upper skin and the diameter adjustment mechanism is uniformly raised so that each point on the upper rim comes simultaneously into contact with the skin.

Example 11 includes a tunable drum that comprises an outer cylindrical shell that includes an upper shell and a lower shell, wherein the upper shell and the lower shell are mutually axially displaceable by a height adjustment mechanism of the drum so as to thereby change an effective height of the cylindrical shell, a lower end of the lower shell constituting a lower end of the outer cylindrical shell.

Example 12 includes a drum that comprises an outer cylindrical shell that includes an upper shell and a lower shell that are mutually axially displaceable so as to thereby change an effective height of the cylindrical shell, a lower end of the lower shell constituting the lower end of the outer cylindrical shell.

Example 13 includes the subject matter of example 12 and, optionally, wherein at least one of the upper and lower shells is coupled to a height adjustment mechanism for axially displacing the upper and lower shells. The height may be adjusted, for example, in response to inducing relative rotation on one or both the upper and lower shells.

Example 14 includes the subject matter of examples 12 or 13 and, optionally, wherein at least one of the upper and lower shells is mutually axially displaceable relative to a seal shell intermediate the upper and lower shells. Optionally, a height adjustment mechanism is provided configured to axially displacing the one of the upper and lower shells.

Example 15 includes the subject matter of example 14 and, optionally, wherein the height adjustment mechanism includes one or more hinges articulated to the upper and lower shells, each of the hinges comprising: a respective upper and lower link having mutually proximate and opposing ends, the opposing ends being hingedly anchored proximate an upper edge of the upper shell and a lower edge of the lower shell, respectively, and the proximate ends being commonly hinged to the seal shell; whereby rotation of one of the upper and lower shells relative to the seal shell in a first direction closes the hinges and reduces the height of the drum while rotation of the one of the upper and lower shells relative to the seal shell in a second opposite direction opens the hinges and increases the height of the drum.

Example 16 includes the subject matter of example 15 and, optionally, wherein the height adjustment mechanism includes a linear bevel gear and pinion gear respectively fixed to the one of the upper and lower shells and to the intermediate seal shell or vice versa.

This overview introduces a selection of concepts in a simplified form that are further described below in the Description of the Figures and the Detailed Description. This Overview is not intended to identify key features or essential features of the claimed subject matter, nor is it intended to be used to limit the scope of the claimed subject matter.

BRIEF DESCRIPTION OF THE FIGURES

The Figures illustrate generally, by way of example, but not by way of limitation, various embodiments discussed in the present document.

For simplicity and clarity of illustration, elements shown in the Figures have not necessarily been drawn to scale. For example, the dimensions of some of the elements may be exaggerated relative to other elements for clarity of presentation. Furthermore, reference numerals may be repeated among the Figures to indicate corresponding or analogous elements. References to previously presented elements are implied without necessarily further citing the drawing or description in which they appear. The number of elements shown in the Figures should by no means be construed as limiting and is for illustrative purposes only. The Figures are listed below.

DETAILED DESCRIPTION OF EMBODIMENTS

Aspects of disclosed embodiments relate to a drum of the type having a cylindrical shell and having at least one audio characteristic that is adjustable by varying an effective diameter of the drum. The effective diameter may be continuously adjustable.

Aspects of disclosed embodiments also relate to allowing an audio characteristic of the drum to be continuously adjusted over a prescribed range by varying the effective height of the cylindrical shell.

The term "tunable audio characteristic" may pertain to the resonant frequency of the drum, tone color and/or any other parameter characteristic of the sound produced.

Non-limiting examples of drums include snare drums, bass drums, floor toms, tom toms and/or any other percussion instrument of the type membranophone.

The positional term "upper" as used herein refers to an element of the drum which is closer to a drummer than the "lower" element, during normal use thereof.

Figure 1:
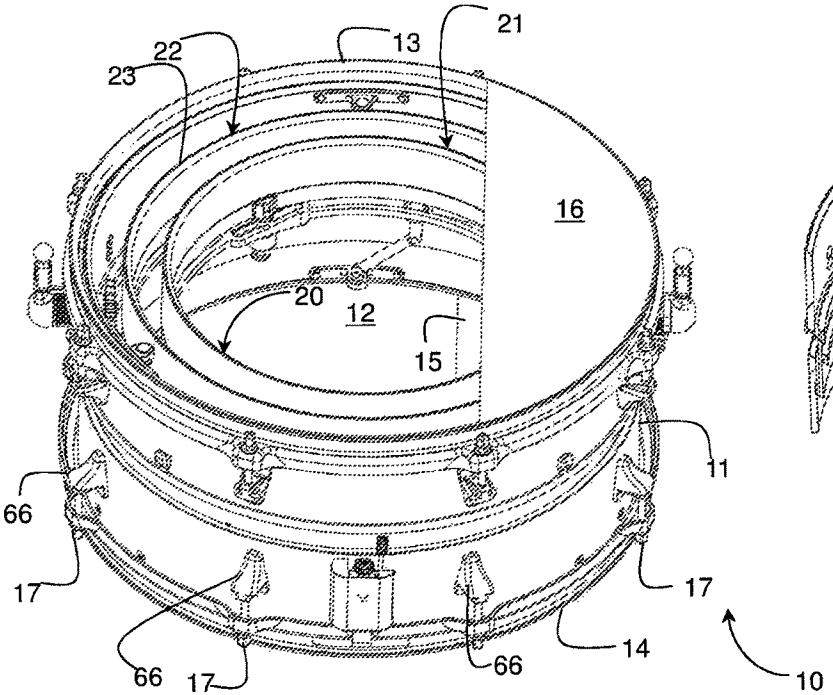
FIG. 1 is a schematic illustration of a pictorial view of a drum according to some exemplary embodiments, having its lower and upper skins partially removed so as to permit the internal structure to be visible.

FIG. 1 shows a tunable drum 10 comprising an outer cylindrical shell 11 defining a hollow housing 12 having opposing open lower and upper ends 13 and 14, respectively. Lower and upper skins (also: membranes) 15 and 16, respectively, may cover a respective one of the lower and upper ends 13 and 14, for example, via hoops, e.g., in conventional manner, so as to allow the tension in the skins to be adjusted via tension rods 17. In some embodiments, a drum may only be covered by upper skin 16.

According to some embodiments, a diameter adjustment mechanism 20 inside the hollow housing 12 is attached to an inner surface of the shell 11 and includes inner cylindrical shells 21 and 22 mounted within the outer cylindrical shell 11 and configured for axial displacement whereby an upper rim 23 of one of the inner cylindrical shells 21 and 22 may be brought into contact with the upper skin 16 and thereby change its effective diameter. Details of a suitable diameter adjustment mechanism 20 are described below with reference to FIGS. 6 to 14A of the drawings. In some embodiments, the diameter adjustment mechanism 20 may be fixedly coupled with the inner surface of the shell 11. In some other embodiments, the diameter adjustment mechanism 20 may be removably coupleable with the inner surface of the shell 11.

It is noted that the cross-section of an inner cylindrical shell does not necessarily have to be circular, but may in some embodiments have other geometries including, for example, rectangular or other polygonal shapes having straight edges, curved edges, pointed vertices and/or curved vertices.

Figure 2B:
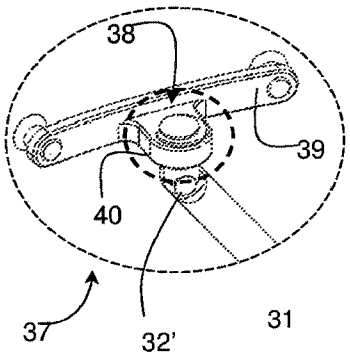
FIG. 2*b* is a schematic illustration of an enlarged detail of a multi-axial hinge used in the height adjustment mechanism, according to some exemplary embodiments.
Figure 2A:
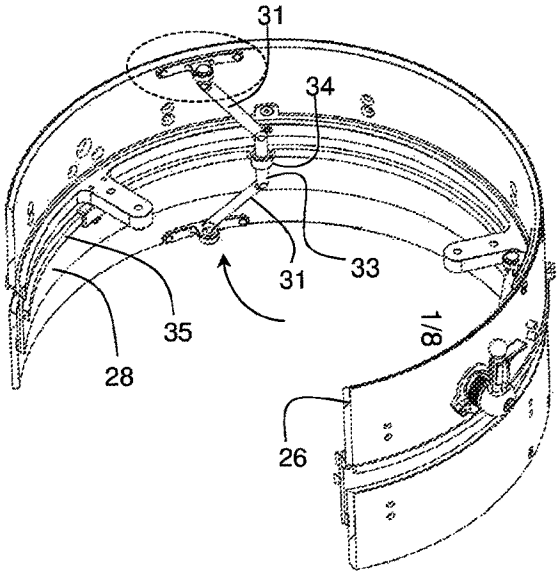
FIG. 2*a* is a schematic illustration of a pictorial view of a partial internal structure of the drum showing in detail a height adjustment mechanism, according to some exemplary embodiments.
Figure 4:
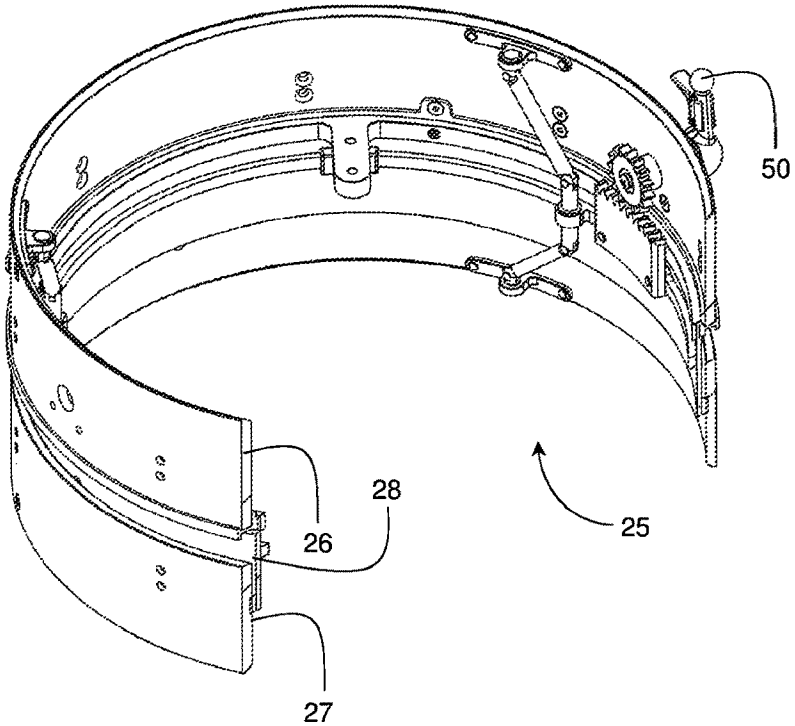
FIG. 4 is a schematic illustration of a pictorial internal view of the drum showing further details of the height adjustment mechanism, according to some exemplary embodiments.
Figure 3:
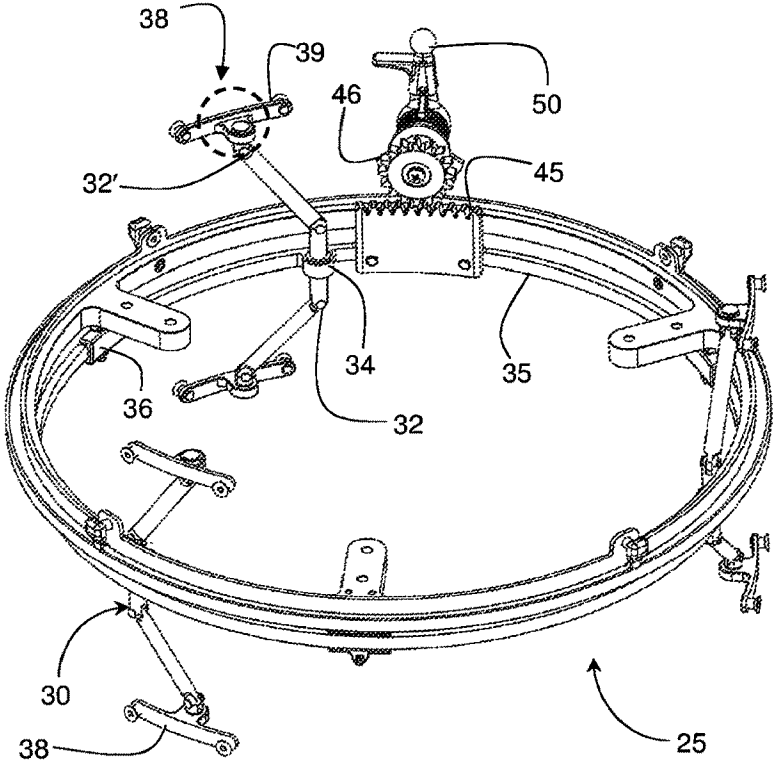
FIG. 3 is a schematic illustration of a pictorial view showing an expanded detail of the height adjustment mechanism, according to some exemplary embodiments.

FIGS. 2 to 4 show a detail of an optional height adjustment mechanism 25, which allows the height of the outer cylindrical shell 11 to be adjusted.

Generally, the height adjustments mechanisms disclosed herein may be configured such that a handle thereof that is used to drive the mechanism can remain stationary during an axial displacement of one of the drum's outer shells. It is further noted that the mechanisms which may be employed for raising and lowering an outer shell can be arranged at an angular distance of 120° from each other. In other word, the mechanisms (e.g., such as multi-axial hinges 30 discussed herein below in more detail) do not necessarily have to be pairwise linked with each other, so that it may suffice to employ only three equally angularly spaced apart raising/lowering mechanisms, which may be arranged on the circumference of the drum. It is additionally noted that some height adjustment mechanism discussed herein may be configured such to not comprise (i.e., to be free of) components that radially traverse through the drum's cavity. Moreover, when considering an intermediate seal to which at least one of the upper and lower shells is mounted, the upper and the lower shell can be synchronized to move simultaneously in mutual axial displacement, or to move separately in axial displacement.

When provided, the outer cylindrical shell 11 may include an upper shell 26 and a lower shell 27 that are (e.g., mutually) axially displaceable relative to each other so as to thereby change an effective height of the outer cylindrical shell 11. This can be achieved by making the external diameter of one of the upper and lower shells slightly smaller than the internal diameter of the other, so that one fits inside the other. In another embodiment, both upper and lower shell 26 and 27 may to be of the same diameter and to be commonly mounted over or within an intermediate seal shell 28 to which at least one of the upper and lower shells is axially displaceable. In the arrangement exemplarily shown in FIG. 2 both the upper shell 26 and the lower shell are fitted over the seal shell 28 and are axially displaceable and rotatable relative thereto.

Optionally, the height adjustment mechanism 25 may be articulated to the upper and lower shells 26, 27, for axially displacing one of or both the upper and lower shells in, e.g., by inducing rotation of both the upper and lower shells 26 relative to the seal shell 28. However, alternative embodiments are feasible. For example, one of the upper or lower shells 26, 27 could be fixedly attached to the seal shell 28, only the other being capable of rotation by the height adjustment mechanism 25 to achieve a similar albeit less pronounced effect.

As best shown in FIG. 3, the height adjustment mechanism 25 may comprise, in some embodiments, one or more multi-axial hinges 30 (shown in enlarged detail in FIG. 2*b*) that are articulated to the upper and lower shells. Each hinge may comprise respective upper and lower links 31, 31' having mutually proximate and distal ends 32 and 32', respectively. The links 31, 31' may be hingedly coupled to a center link 33 that is rotatably and slidably mounted within sockets 34 supported on a circular rail 35 that is slidingly supported within brackets 36 fixedly attached to the inner wall of the seal shell 28. The distal ends 32, 32' of the two links 31, 31' may be fixedly attached to the inner wall of the lower and upper shells, respectively, e.g., via a ball and socket type joint 37, such as to allow multi-axial rotation of the links relative to the shells. This can for example be achieved by articulating the distal end of each link to a mounting link 38 in the form of a plate 39 that is fixed to the inner wall surface of the shell and which supports a socket 40 that retains the mounting link for axial rotation. Several such hinges 30 may be angularly spaced apart around the inner wall surface of the drum. The upper and lower links 31, 31' of the hinges 30 act as knee joints that are adapted to bend sideways and swivel so that when bent outwards their respective opposing ends 32, 32' splay apart and displace the upper and lower shells outwards relative to the seal shell 28, thereby increasing the height of the drum. Conversely, when the knee joints collapse, the links 31, 31' displace the upper and lower shells into the seal shell 28, thereby decreasing the height of the drum. In practice, the lower shell 27 is fixedly supported on a stand and rotation of the seal shell 28 relative to the upper and lower shells 26, 27 causes the hinges 30 to open or close.

Figure 5:
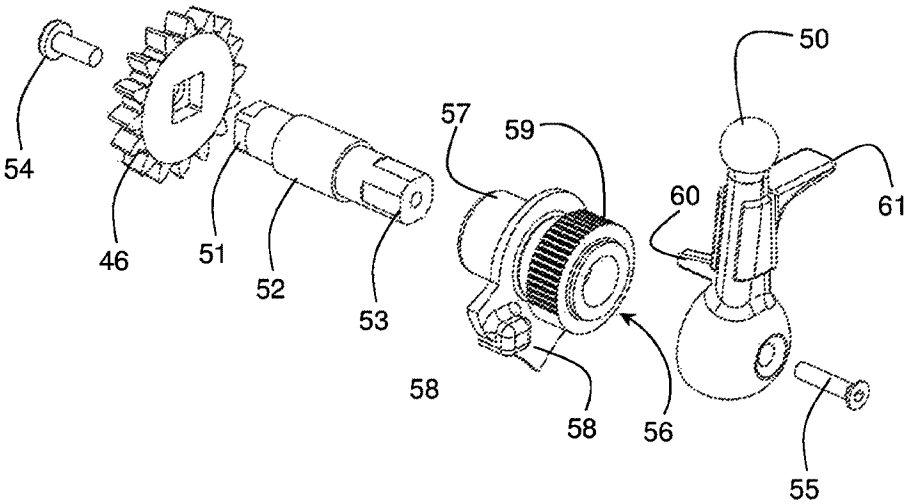
FIG. 5 is a schematic illustration of an exploded pictorial view of a calibrated operating handle for the height adjustment mechanism, according to some exemplary embodiments.

In some embodiments, a first linear gear 45 may be fixed to the circular rail 35 and a first pinion gear 46 is mounted to the upper shell 26 and engages the first linear bevel gear 45, so as to induce rotation of the circular rail 35 relative to the seal shell 28 so that rotation of the first pinion gear 46 in a first direction closes the hinges and reduces the height of the drum while rotation in a second opposite direction opens the hinges and increases the height of the drum. The first pinion gear 46 is rotatable in either direction, e.g., by an operating handle 50 shown in exploded view in FIG. 5 and/or by a powered drive. The first pinion gear 46 may have a bore having a polygonal (e.g., square) cross-section which engages a first end 51 of an axle 52 both of whose ends are of square cross-section and whose second end 53 engages the handle 50, whereby rotation of the handle 50 rotates the first pinion gear 46 and thereby rotates the circular rail 35. The first pinion gear 46 and the handle 50 are secured to the axle using bolts 54 and 55, respectively.

In some embodiments, a clutch 56 may be employed that has a tube 57 and that is mounted over the axle 52 through an aperture (not shown) formed in the side wall of the drum. The tube 57 may support a plate 58 external to the side wall of the drum and to which it is fixedly attached via screws (not shown). Part of the tube 57 thus projects outward from the side wall of the drum and around this external part of the clutch are formed ridges 59 that are engaged by a projection 60 on the handle 50. The projection 60 is resiliently biased into engagement with the ridges 59, but may be lifted out of engagement by a release armature 61. Thus, in normal use the clutch 56 engages the handle 50 and prevents rotation thereof. When the drummer wants to operate the height adjustment mechanism 25, he lifts the release armature 61, thereby facilitating rotation of the handle 50 and of the first pinion gear 46. When he frees the release armature 61, it re-engages the ridges 59 thereby preventing further inadvertent rotation of the handle 50.

It should be noted that in alternative arrangement (not shown) the seal shell may be omitted and the upper and lower shells may be mutually rotatable, at least one of which being coupled to a height adjustment mechanism for displacing the upper and lower shells. The shells may be axially displaced, for example, responsive to inducing relative rotation of the upper and lower shells. For example, the lower and upper shells may be threadably connected, whereby relative rotation induces axial displacement by an amount that depends on the pitch of the screw thread.

Figure 6:
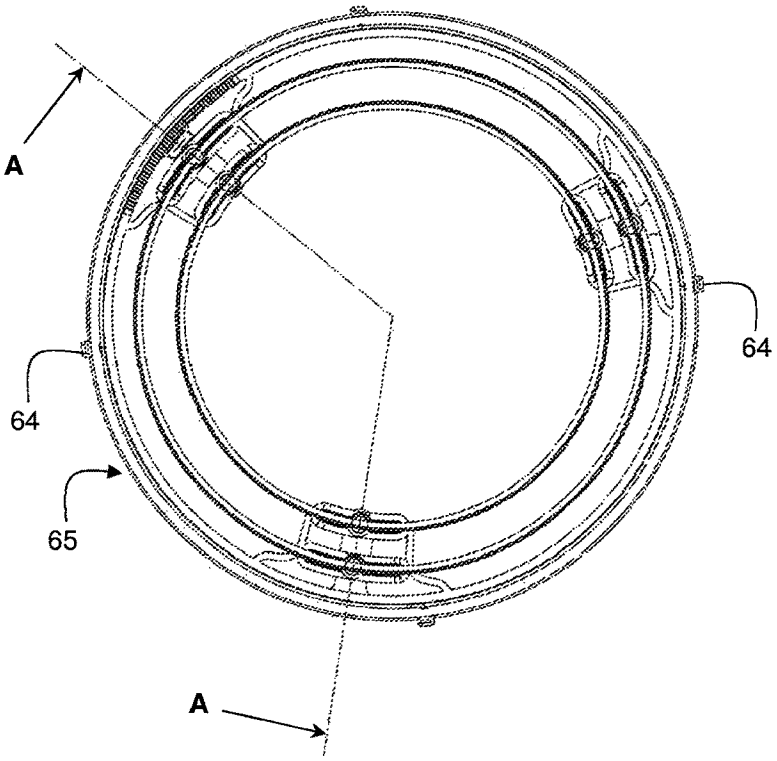
FIG. 6 is a schematic illustration of a plan view of a diameter adjustment mechanism, according to some exemplary embodiments.
Figure 8:
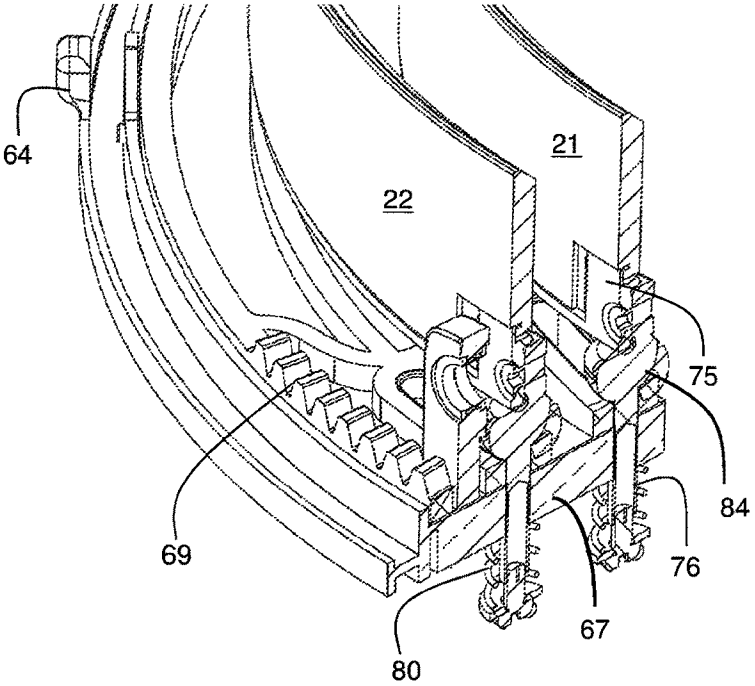
FIG. 8 shows an enlarged detail of FIG. 7.
Figure 7:
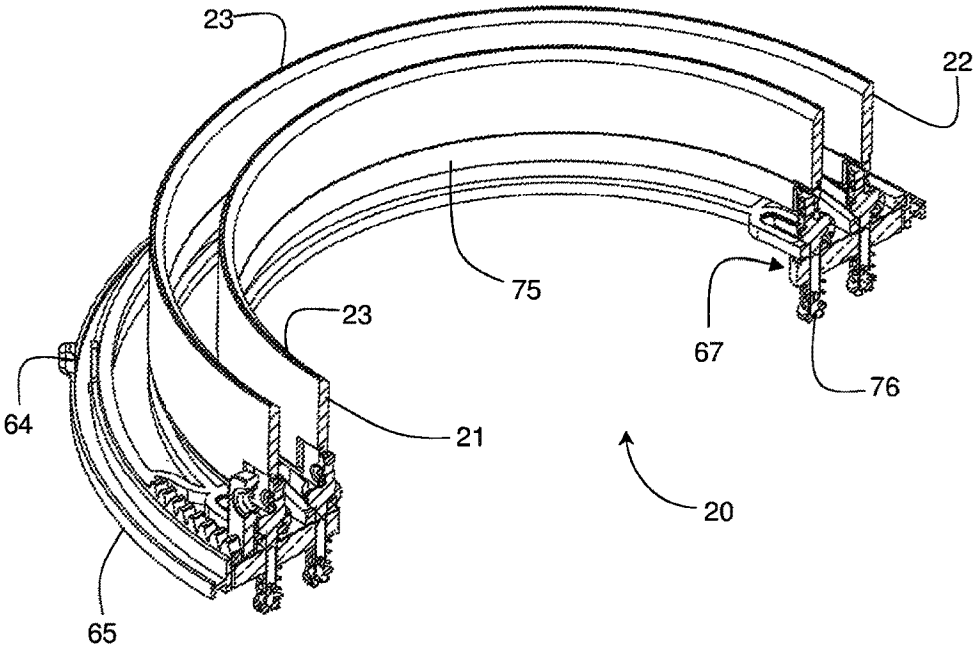
FIG. 7 is a schematic illustration of a sectional view along the line A-A in FIG. 6 showing a detail of the diameter adjustment mechanism, according to some exemplary embodiments.
Figure 11:
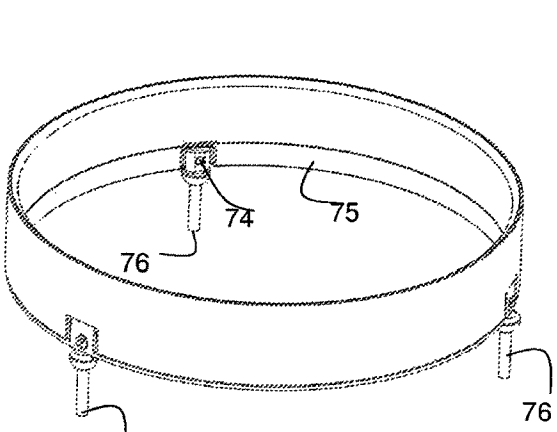
FIGS. 11 to 12B schematically show further details of the diameter adjustment mechanism, according to some exemplary embodiments.

FIG. 6 is a schematic plan view of the diameter adjustment mechanism 20, FIG. 7 is a schematic cross-sectional elevation taken through line A-A in FIG. 6 and FIG. 8 is an enlarged detail of FIG. 7. Further details of the diameter adjustment mechanism 20 are schematically shown in FIGS. 9 to 12A of which the latter is an exploded view. The diameter adjustment mechanism 20 may comprise an outer static rim 65 that is removably coupleable or which is coupled with (e.g., screwed) to the inside wall of a drum shell (e.g., upper drum shell) via one or more outer coupling adaptors 64. Optionally, a fastening mechanism may be employed which allows operably and removably coupling of the static ring 65 with the drum. For instance, the static ring 65 may be removably coupleable to existing screws of the drum. Such fastening mechanisms may include adjustable snap-fittings, ratchets, clamps, and/or the like. Optionally, inner parts of lugs 66 may be used for operably (removably) coupling the static ring 65 with the drum.

Optionally, a coupling adaptor 64 may be fixedly coupled with the outer shell of the drum using clamps that are clamped onto elements of the inner side of the outer cylindrical shell of the drum. Optionally, a coupling adaptor 64 may be fixedly coupled with the outer shell of the drum using a ratchet mechanism, for connecting the coupling adaptor 64 with elements of the outer cylindrical shell of the drum.

Figure 12B:
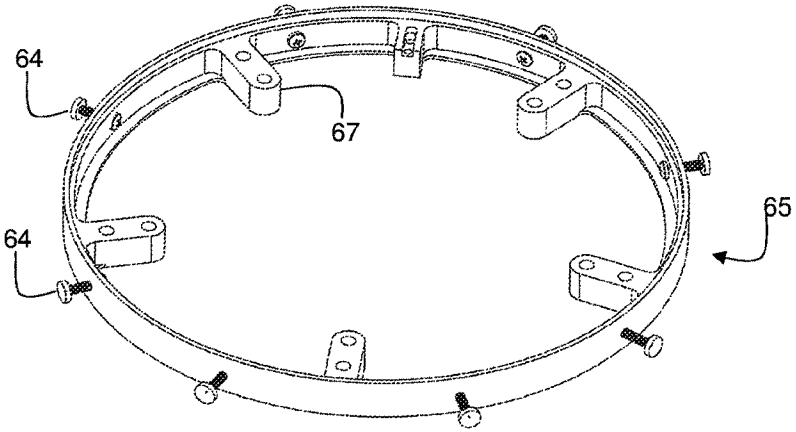
Figure 12A:
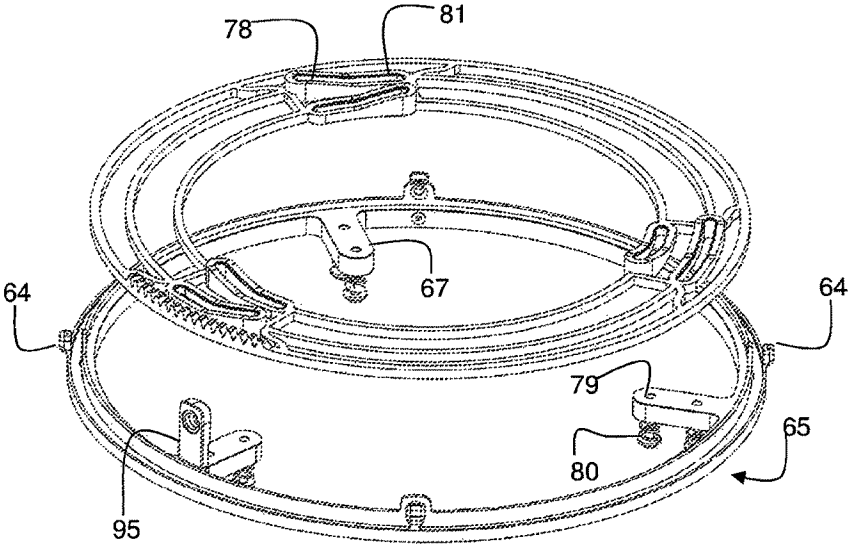

FIG. 12B shows another embodiment of coupling adaptors 64 comprising, e.g., radially displaceable head portions (e.g., of a threaded bolt) for abutting or press against the inner side of the outer shell 11 of the drum, e.g., to force-fittingly secure the outer static rim 64 within the drum shell.

Around an inner periphery of the static rim 65 are affixed radially projecting supports 67 that support an inner rotatable rim 68, which is adapted to rotate both clockwise and counter-clockwise relative to the static rim. The inner cylindrical shells 21 and 22 may be supported on the inner rotatable rim 68, which includes at an outer periphery thereof a second linear gear 69 that engages a second pinion gear 70 extending through the outer shell of the drum and operable by a handle 71, which may be coupled with the static rim with vertical bracket 95 using a suitable coupler element (e.g., a bolt, or screw).

The rotatable rim 68 supports at least one ramp 72 for each inner cylindrical shell 21, 22, there being exemplary shown three such ramps angularly displaced apart by about 120°. Each ramp 72 is thus rotatable relative to the outer cylindrical shell of the drum and is dimensioned such that when a lower rim of the respective inner cylindrical shell 21, 22 is supported at an upper end of the ramp, the upper rim of the cylindrical shell abuts the upper skin 16 and when the lower rim of the inner cylindrical shell is supported at a lower end of the ramp, the upper rim is clear of the upper skin 16. It will be understood that when the upper rim of the cylindrical shell abuts the upper skin 16, the effective diameter of the upper skin is reduced, thus altering the resonant frequency of the drum.

The provision of one or more inner cylindrical shells, allows the effective diameter of the upper skin 16 to be reduced, e.g., to corresponding predetermined one or more discrete values each having a different characteristic frequency.

In some embodiments, at least one of the one or more inner cylindrical shells may be configured such that its diameter can be selectively increased and decreased, e.g., as outlined further below in more detail.

While the inner cylindrical shells 21, 22 are shown concentric in the drawings and are likewise concentric with the outer shell, this is not essential to the operating principles of the diameter adjustment mechanism 20, but concentricity may be preferable since a drummer will normally aim to strike the upper skin toward the center. Likewise, while the inner shells are schematically shown as having a circular cylindrical shape, they do not necessarily need to be of circular cross-section.

In some embodiments, mounted over each of the ramps 72 may be a respective circular (e.g., metal) ring or hoop 75 shown best in FIGS. 7 and 8 that rigidly supports the respective inner cylindrical shell in, for example, a snap-fit engagement and which is fixedly attached to coupler bolts 76 around its periphery, for example by screws, nuts and bolts or rivets via bore 74. Such snap fit arrangement may also be employed if no metal ring is used. The inner cylindrical shells 21 and 22 may be formed of wood or plastic both of which are susceptible to slight deformation, and/or of any other suitable material. The ring 75 may optionally be employed, for example, to hold the inner cylindrical shells 21 and 22 securely and inhibits such deformation. Each coupler bolt 76 may project downward through a longitudinal slot 78 in a respective one of the ramps 72 and through a bore 79 in a respective one of the radially projecting supports 67. An upwardly diverging support surface 84 of the coupler bolt 76 may be biased against the ramps by a mechanical energy storage device 80 (e.g., a spring) so that the coupler bolt 76 is retained in abutting contact with a lower surface 81 of the ramp 72. Thusly configured, the shells are 21/22 are biased downwards. The mechanical energy storage device may be mounted over a lower end of the coupler bolt 76 and disposed between the said lower end and the undersurface of the radially projecting support 67.

In conventional arrangements, the upper skin 16 and/or the lower skin 15 are tuned using the tension rods 17. It is difficult and takes time to tune the skin correctly, since all the tension rods must be at the same tension around the skin. In contrast, the present invention avoids the need to tune the skin by individual adjustment of all the tension rods since tuning is achieved merely by turning the turning handle 71 so as to raise the selected cylindrical shell 21 or 22 onto which, optionally, the ring 75 may be mounted. By such means, the effective diameter of the upper skin is changed and is also perfectly tuned or tunable, since the mechanism supports a uniform or substantially uniform vertical movement of the cylindrical shells 21 and 22 towards the skin, thus resulting in fast adjustment and uniform tension of the skin. The one or more inner shells are configured such that when their upper rims or edges are pressed against the skin, the latter can still vibrate to provide a drum sound responsive to hitting the skin. In other words, the diameter adjustment mechanism is configured to avoid muting drum but to change a pitch that can be created by the drum responsive to drumming thereon. As outlined herein, the one or more inner shells have an annular or ring-shaped body to allow vibration of the skin in and out of the inner cavity defined by the ring-shaped body. Optionally, the number of sound boxes defined by or enclosed in the drum may remain unchanged responsive to operably engaging one of the inner shells towards an upper and/or lower skin. Optionally, one or more inner shells may be lowered to engage with a lower skin of the drum to change an audio characteristic of the drum when drumming onto the upper skin. Optionally, a first inner shell may be brought in contact with the inner surface of an upper skin and, at the same a second inner shell may be brought in contact with the inner surface of a lower skin.

Figure 10:
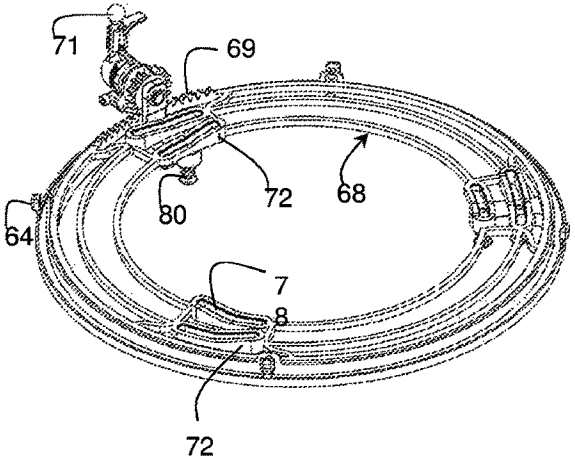
FIGS. 9 and 10 schematically show details of the diameter adjustment mechanism, according to some exemplary embodiments.
Figure 9:
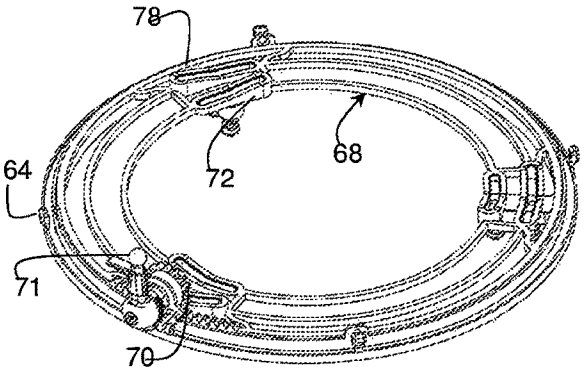

With particular reference to FIGS. 9 to 12B, it is seen that the rotatable rim 68 supports two series of radially displaced ramps 72, one for each of the inner shells 21 and 22. The ramps of one series are mounted in anti-phase relative to the ramps of the other series, i.e., the one or more ramps in a first series have a positive gradient in a clockwise direction while the one or more ramps of the other series have a negative gradient in a clockwise direction. In normal operation where the full diameter of the upper skin 16 is utilized, the second pinion gear 70 (FIG. 9) may be located mid-way along the second gear 69 and the respective mid-points of the two anti-phase ramps are aligned whereby the lower rims of the respective inner shells 21 and 22 (formed, e.g., by the lower edge of metal ring 75 shown schematically in FIG. 11) are supported at equal levels. The second pinion gear 70 can be operated by the handle 71, which in this situation points vertically upwards as shown in FIG. 10. Turning the handle 71 through an, e.g., quarter-turn, in one direction rotates the ramps 72 of one of the two series ramps in the same direction, causing one of the ramps to push upward against the lower rim of the respective inner shell 21/22 (e.g., by engaging against, while the surface of the other ramp becomes more distant from the lower rim of its respective inner shell 21/22, causing the coupler bolt 76 to be retracted under the bias force of the mechanical energy storage device 80. The mechanical energy storage device 80 also serve to retract the inner shells 21, 22 when the handle 71 is returned to its neutral position. The stroke of the second gear 69 is such that turning the handle to its fullest extent in either direction sufficiently raises the respective inner cylinder so that its upper rim contacts the upper skin 16, thereby changing the effective diameter thereof to that of the inner cylinder.

Figure 13A:
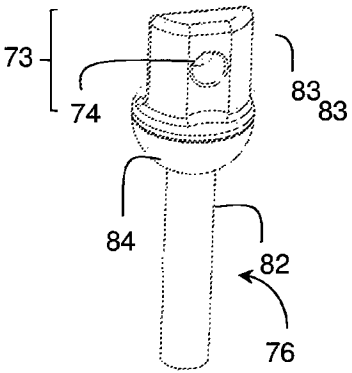
FIG. 13A schematically shows an enlarged detail of a coupler bolt used in the diameter adjustment mechanism, according to some exemplary embodiments.
Figure 13B:
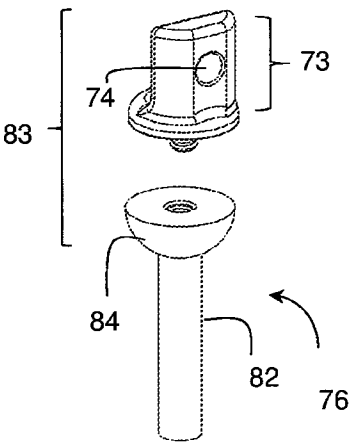
FIG. 13B schematically shows an enlarged exploded detail of the coupler bolt used in the diameter adjustment mechanism, according to some exemplary embodiments.

Additionally referring to FIGS. 13A and 13B it is seen that the coupler bolt 76 may, in some embodiments, be of two-part construction having a lower shank 82 extending to an upper part 83 of the coupler bolt 76. The upper part 83 comprises an upper body portion having the upwardly diverging support surface 84. Optionally, the upper body portion defining the upwardly diverging support surface 84 may be formed as a half-sphere. The diverging support surface 84 is positioned and configured to slidably engage with the ramps 72 while the lower shank 82 is positioned within the longitudinal slot 78.

Lower shank 82 supports the spring (or any other mechanical energy storage device) as shown in FIG. 8. Optionally, the coupler bolt 76 is length-adjustably (e.g., threadably) coupled with an upper part 83 (FIGS. 13A and 13B), which is fastened to or coupled with the rotatable rim 68. This allows the length of the bolts to be finely adjusted so as to compensate for any slight misalignment in mounting the static rim 65 on the inner wall surface of the outer cylindrical shell 11 and thereby ensures that the inner shells 21/22 sit level and parallel to the plane of the upper skin 16. This ensures that when the inner shells are raised their upper rims contact the upper skin uniformly. Optionally, the upper part 83 comprises a fastening unit 73 comprising, e.g., bore (also: through-hole) 74 for form and force-fittingly coupling with the rotatably rim 68, e.g., by a nut and a bolt or rivets. Optionally, the area extending along the longitudinal axis of the bore 74 may have a circularly-shaped cross-section. Optionally, the area defined by bore 74 may have an oblong (not shown) cross-section such as, for example, elliptical cross-section, extending lengthwise from the lower rim to the upper rim 23. By employing such oblong cross-section By allowing the coupler bolt 76 to be length-adjustable and/or having a bore 74 having an oblong cross-sectional geometry, the orientation and/or position of the static rim 65 relative to the inner wall surface can be finely adjusted, e.g., so as to compensate for any slight misalignment in mounting the static rim 65 on the inner wall surface of the outer cylindrical shell 11. This ensures that when the inner shells 21 and 22 are raised their upper rims contact the upper skin uniformly.

Figure 14A:
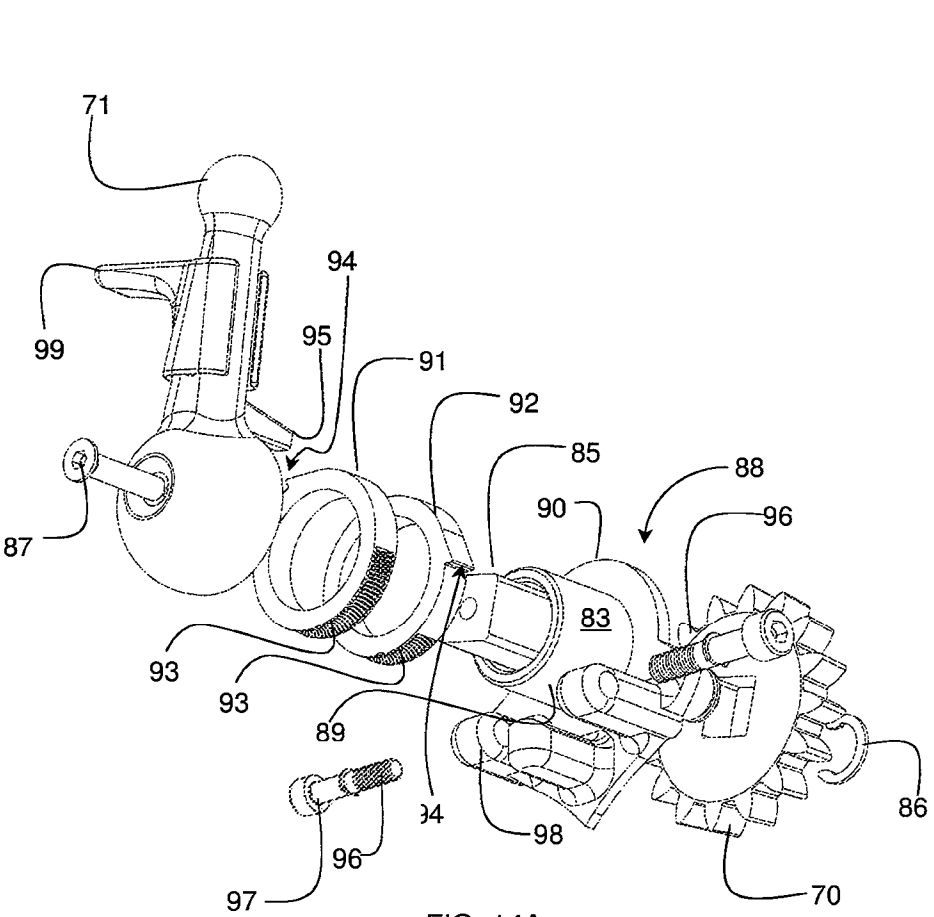
FIG. 14A is a schematic illustration of an exploded pictorial view of a calibrated operating handle for the diameter adjustment mechanism having two preset limits, according to some exemplary embodiments.

FIG. 14A is an exploded view showing the construction of the operating handle 71.

Generally, an operating handle may comprise an arresting mechanism that may serve to lock the inner shell 21/22 into its raised position against the bias of the mechanical energy storage devices 80.

As exemplified in FIG. 14A, the second pinion gear 70 comprises a bore having a polygonal (e.g. square) cross-section. The bore engages engages a first end of an axle 85 both of whose ends are of square cross-section and whose second end engages the handle 71, whereby rotation of the handle 71 rotates the second pinion gear 70, which may be secured to the end of the handle, e.g., by a circlip 86 or any other suitable coupling mechanism. The handle 71 is secured to the second end of axle by a bolt 87. An adjustable clutch 88 has a tube 89 that is mounted over the axle 85 through an aperture (not shown) formed in the side wall of the drum. The tube 89 supports a plate 90 external to the side wall of the drum and to which it is fixedly attached via screws (not shown). Part of the tube 89 thus projects outward from the side wall of the drum and around this external part of the clutch 88 there are mounted dials 91 and 92 having ridges 93. The dials 91 and 92 are generally circular but have a notch 94 formed in an edge that is adapted to engage a projection 95 that extends from the handle 71. It is seen that the two notches 94 are oriented in anti-phase so that rotation of the handle 71 in one direction engages one of the notches 94, while rotation in the opposite direction engages the other notch 94. Once adjusted, the dials 91 and 92 are fixed and cannot rotate so that the notches 94 serve to arrest the handle 71 and prevent further rotation. These dials 91 and 92 may serve as an arresting mechanism for tuning the drum to a desired pitch for the respective inner shells. They also serve to lock the inner shell 21/22 into its raised position against the bias of the mechanical energy storage devices 80. The ridges 93 of the two dials engage complementary ridges 96 in the head portion of a respective threaded Allen bolt 97, which threadably engages a mount 98 supported by the plate 90. Prior to assembly, the dials can be freely rotated to provide approximate end-stops where their respective notches abut the projection 95 and arrest further rotation of the handle. However, after assembly the threaded engagement between the Allen bolts 97 and the mounts 98 prevents further rotation of the dials 91 and 92. To allow for fine rotation of the dials 91 and 92 after assembly, the Allen bolts may be rotated in either direction whereby their threaded head portions operate as worm gears that fractionally rotate the respective dials. This allows the dials to be pre-set and then adjusted slightly as necessary so that full rotation of the handle in either direction raises a respective one of inner shells 21 and 22 by just the right extent to produce the required frequency or tone. The projection 95 may be lifted clear of the notches 94 by a resilient release armature 99, which allows the clutch to be overridden if required.

Figure 14D:
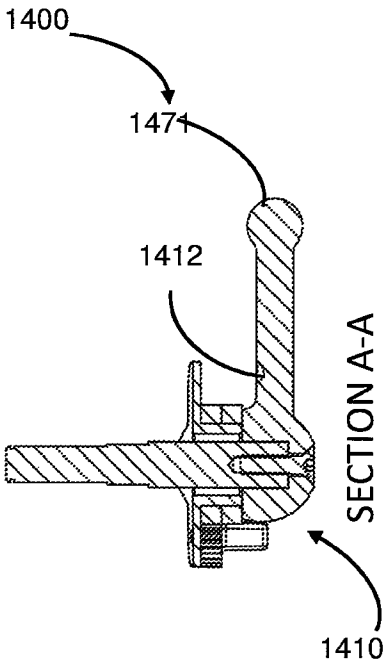
FIG. 14D is a schematic cross-sectional side-view illustration of the handle shown in FIG. C along virtual lines A-A.
Figure 14C:
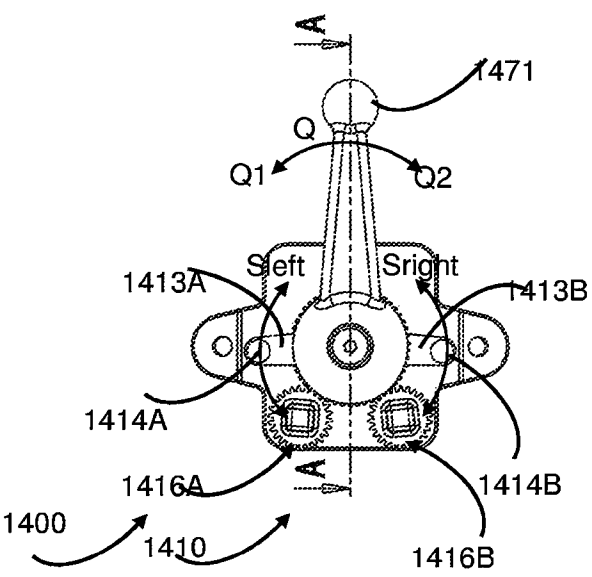
FIG. 14C is a schematic front view illustration of the handle shown in FIG. 14B.
Figure 14B:
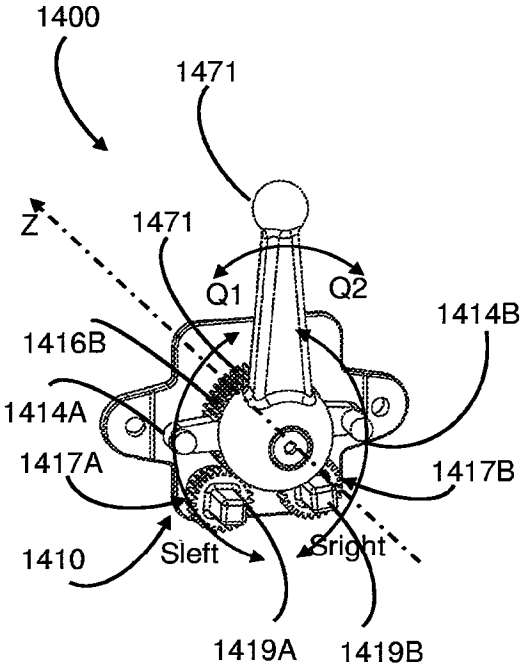
FIG. 14B is a schematic pictorial illustration of a handle comprising a tuning mechanism, according to some embodiments.
Figure 17:
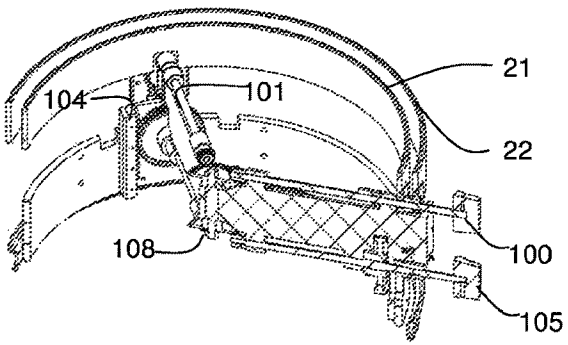
FIGS. 15A to 17 schematically show details of a height and diameter adjustment mechanism according to some other exemplary embodiments.
Figure 16:
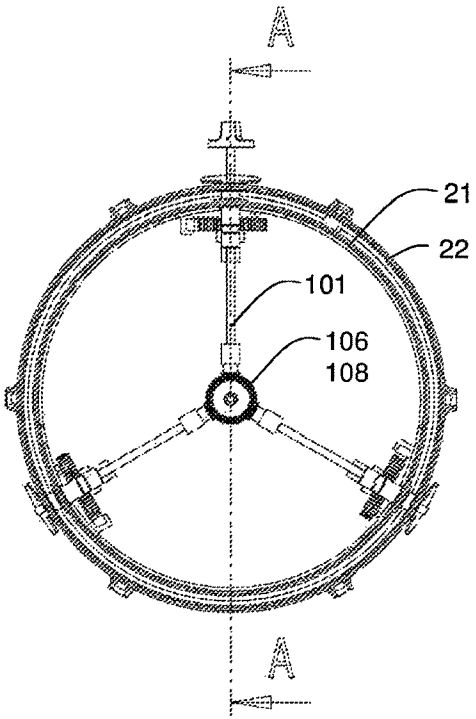
Figure 15A:
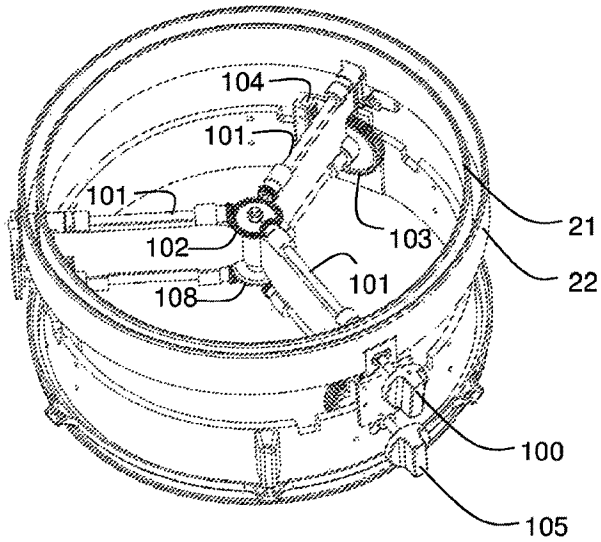
Figure 15B:
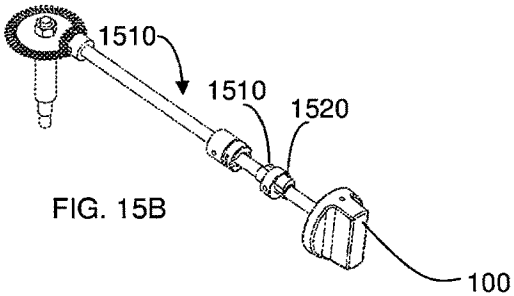
Figure 20A:
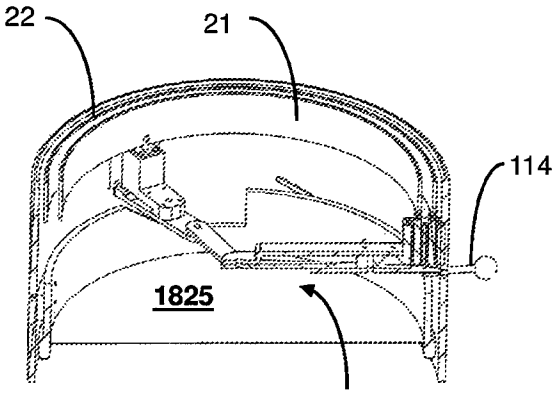
FIGS. 18 to 20B schematically show details of a height and diameter adjustment mechanism according to yet another exemplary embodiment.
Figure 19:
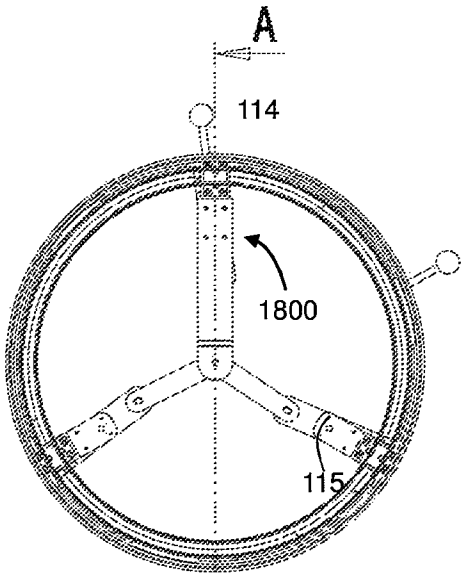
Figure 18:
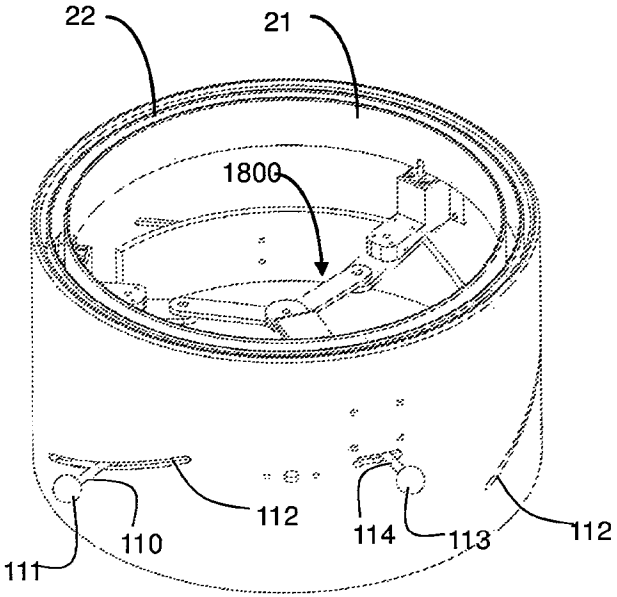
Figure 20B:
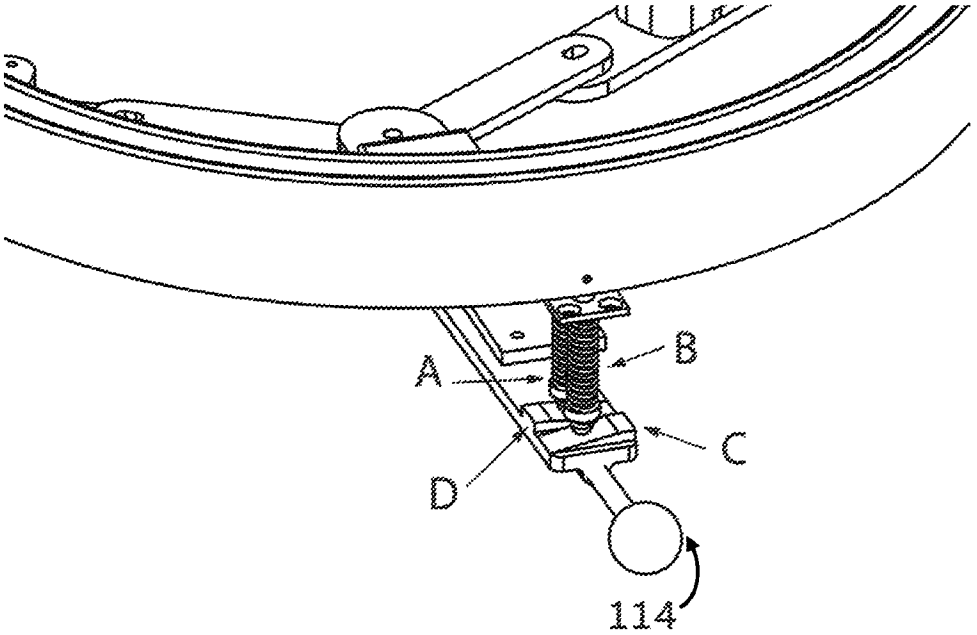

Referring now to FIGS. 14B to 14D, a handle arrangement 1400 according to an embodiment may comprise a handle 1471 (or otherwise rotatable gear) and an arresting mechanism 1410 for adjusting the extent of rotation of handle 1471, schematically indicated by double-sided arrow Q, around its rotation axis Z (FIG. 14B). As exemplified herein, arresting mechanism 1410 may employ a pin-notch interlock or otherwise snap-fitting mechanism.

An extent of rotation to the left (Q1) and to the right (Q2) with respect to positive Z direction from a "vertical" position schematically shown in the FIGS. 14B-14C can be individually adjusted. An extent of rotation to the left (Q1) and to the right (Q2) of handle 1471 can be adjusted by rotating and fixing left and right adjustment arms 1413A and 1413B (FIGS. 13A and 13B) having corresponding outwardly protruding left and right dials 1414A and 1414B, into a desired orientation relative to handle 1471 having a detent portion or notch 1412 formed on its inner surface facing the dials 1414A and 1414B. Independent rotation of left and right adjustment arms 1413A and 1413B is schematically illustrated by double-sided arrows $S_{left}$ and $S_{right}$. Left and right adjustment arms 1413A and 1413B may each be rotatably mounted on a corresponding main gear 1416A and 1416B that engages with corresponding adjustment gears 1417A and 1417B having shaft axles 1419A and 1419B of polygonal (e.g., square) cross-shape which can be rotated using a corresponding wrench (not shown). By rotating one of the shaft axles 1419A and 1419B, the corresponding adjustment gear (1417A or 1417B) rotates, imparting a rotating force on the corresponding main gear 1416A or 1417B. In turn, the orientation of left dial 1414A or right dial 1414B changes.

Handle 1471 may be rotated to the left (Q1) until left dial 1414A slides into and fittingly engages with notch 1412, and rotated to the right (Q2), until right dial 1414B slides into and fittingly engages with notch 1412. In this manner, the extent of height adjustment of the inner and outer shell may be set by the user. Otherwise stated, and as already indicated herein, the arresting mechanism serves to lock the inner shell 21/22 into its raised position against the bias of the mechanical energy storage devices 80. In this way, the drum can be tuned to a desired predetermined pitch with respect to each effective diameter. Additional audio characteristics or parameters that may be adjusted and set to a desired value can include pitch and/or tone. It is noted that the dials 91 and 92 mentioned herein serve the same purpose.

In some embodiments, adjustment gears 1417A and 1417B may each be selectively locked and unlocked, to correspondingly lock and unlock the orientation of dials 1414A and 1414B relative to handle 1416A in a desired position. When the adjustment gears 1417A and 1417B are unlocked, they can be set to engage with groove 1412 such that rotation of handle 1471 causes the rotation of adjustment gears 1417A and 1417B which, in turn, causes the adjustment of the arresting mechanism for limiting the height adjustment of the inner shells. If the desired pitch is obtained, the adjustment gears 1417A and 1417B may be secured into the desired positions which, in turn, locks the dials 1414A and 1414B in the corresponding positions that correspond to respective desired pitches which are user-selectably generated by the inner and outer shells. By locking the dials 1414A and 1414B in their positions, the handle 1471 may be rotated so that groove 1412 disengages from the dials 1414A and 1414B without causing rotation of the latter.

In some alternative embodiments of arresting arrangement 1410, the inner surface of handle 1471 may be provided with a pin and the adjustment arms 1413A and 1413B may be provided with corresponding notches for fittingly engage with the said pin.

It is noted that additional or alternative handles or handle mechanisms may be employed for selectively raising and lowering one of a plurality of inner shells that may be employed by the drum. For example, handles 50, 71 or 1471 may be mounted off-axis to axle 85 and be operably coupled therewith via a suitable gear transmission mechanism (not shown). Such gear transmission may employ a planetary gear, a spur gear drive, and/or the like.

The diameter adjustment mechanism 20 and the height adjustment mechanism 25 as exemplarily described and schematically shown in the drawings have been designed to utilize peripheral elements such as the multi-axial hinges 30 and the first and second linear gears 45 and 69. Such a design causes minimal disruption or interference with the main hollow volume of the drum. However, it is to be understood that the details of the diameter and height adjustment mechanisms as described are by way of example only and other designs may be employed without detracting from the scope of the invention as claimed. Some non-limiting alternatives have already been mentioned. Others include the possibility to raise and lower the inner cylindrical shells via a respective pinion gear that is adapted to engage a linear gear mounted on an outer surface of each of the inner cylindrical shells.

FIGS. 15A to 17 schematically show such an embodiment where a first handle 100 rotates a rod 101 whose rotation operates an upper bevel gear 102 that induces rotation of a crankshaft 1510 (see exemplary detail in FIG. 15B) having first and second crankpins 1521 and 1522 to, respectively, alternatingly raise one of the inner shells 21 and 22 while lowering the other. By such means, rotation of the handle 100 brings the inner shell (e.g., inner shell 21) into contact with the upper skin 16 and changes the effective diameter of the drum, thereby implementing a diameter adjustment mechanism according to some embodiments. It is noted that other mechanisms may be employed for the conversion of rotating motion into a linear motion. Such mechanisms may include, for example, a crank mechanism that comprises rotatable knob having an off-axis mounted linkage that is coupled to a slider element (not shown), and/or the like. It may suffice to employ three rods 101 forming an angle of 120° degree between. In other words, the rods 101 may form a star-like configuration. Components of the diameter adjustment mechanism may extend through the inner cavity of the drum and may thereby affect the drum's sound quality.

Likewise, with regard to the height adjustment mechanism, some alternatives have already been suggested. The height adjustment mechanism employs, in some embodiments, two outer shells of equal diameter that are both axially displaceable relative to an inner seal shell. But as already noted one of the outer shells may be fixed and instead of using a hinge having two multi-axis joints, one for each of the outer shells, a hinge having only a single multi-axis joint may be used to displace the one outer shell that is capable of axial displacement. Referring again to FIG. 15, a height adjustment mechanism may comprise a second handle 105 that may be used to operate a lower bevel gear 108 that turns a pinion gear 103 that engages a linear bevel gear 104 fixed to a moveable lower shell of the drum casing so as to facilitate height adjustment thereof. It will also be understood that there is no absolute requirement for the outer shells to have identical diameters, the seal shell can be dispensed with altogether and two outer shells can be mutually displaceable at least axially and optionally also rotatably. The possibility to employ a screw-threaded engagement has already been mentioned. Also possible is to displace the two shells using a rack and pinion whereby a pinion gear supported by one of the shells engages a linear bevel gear vertically mounted on an internal or even external surface of the other, so that rotation of the pinion gear axially displaces the two shells to or away from each other depending on the direction of rotation.

FIGS. 18 to 20B schematically show yet another approach of a height adjustment mechanism where a rod 110 is operated by a handle 111 to move within an inclined slot 112. The rod is attached or otherwise articulated to a sound box shell 1823 whereby moving the rod 110 within the inclined slot raises or lowers the sound box shell 1823 to which a skin 1825 may be attached for decreasing or increasing the drum's cavity. Optionally, rods connected to any but the sound box shell 1823 might have to pass through the sound box shell 1823 and/or an intermediate inner shells 21 of smaller diameter, thus requiring that all shells apart from the largest one are provided with inclined slots so that movement of the rod moves the shell to which its end is attached.

Also shown is a diameter adjustment mechanism comprising a handle 113 coupled to a rod 114 that operates a star-shaped linkage 115, which may act in a manner similar to that of the bevel gear as described above with reference to FIGS. 15 to 17. Both inner cylindrical shells 21 that are shown are connected to a slidable pin A and B. By moving the handle 113 in a first direction (e.g., to the right according to the configuration shown in FIG. 20B), the slidable pin A that is connected to the first inner cylindrical shell 21 will slide up on an inner ramp D, and cause the first inner cylindrical shell 21 to move up toward the skin. In the same way it will raise the second inner cylindrical shell 22 by moving handle 113 to the left, i.e., the slidable pin B that is connected to the second inner cylindrical shells 22 will slide up on a ramp C, and thus cause the second inner cylindrical shell 22 to move up toward the skin. The upward movement of the inner cylindrical shells 21 and 22 can be reversed by correspondingly moving the handle in the other direction. The ramps C and D may be arranged to have opposite orientations relative to each other. In this way, moving handle 114 in a first direction causes only one of the inner cylindrical shells to be raised, while the other inner cylindrical shell may be lowered. A central linkage mechanism 1800 may be connected to handle 114 to transmit the force required for levelled raising of the inner cylindrical shells 21/22.

According to some embodiments, a static rim may have an adaptable diameter, i.e., its diameter can be varied, e.g., manually, automatically and/or semi-automatically, so that the adjustable static rim can securely abut or press against the inner side of the outer shell 11 of the drum. This may obviate the need of employing coupling elements for securing the static rim to the drum. Moreover, this allows greater flexibility in operably mounting the static rim into the inner side of drums of different diameters. In some embodiments, the static rim may be pressed against the inner surface of the outer shell using expandable units (e.g., inflatable units such balloons).

Figure 21C:
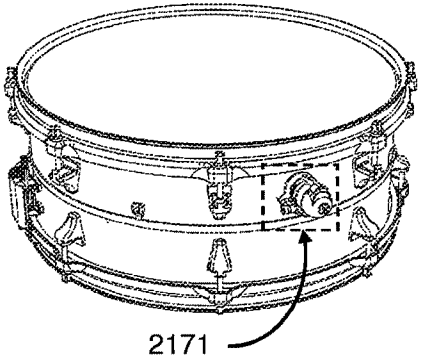
FIG. 21C is a schematic illustration of a pictorial view of a powered handle mechanism, according to some embodiments.
Figure 21B:
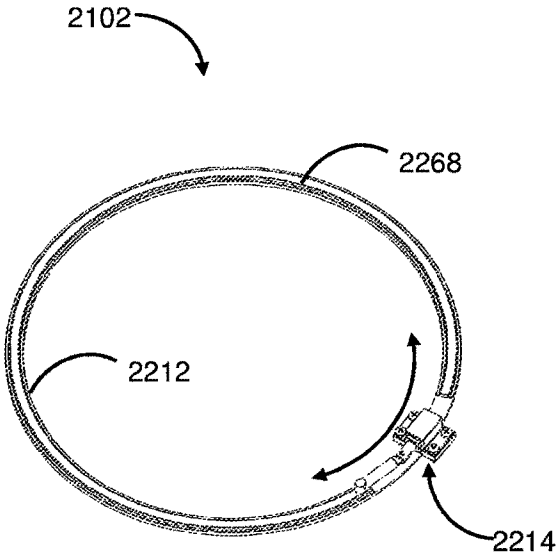
FIG. 21B is a schematic illustration of a pictorial view of a circular frame body having an adjustable diameter, according to some other embodiments.
Figure 21A:
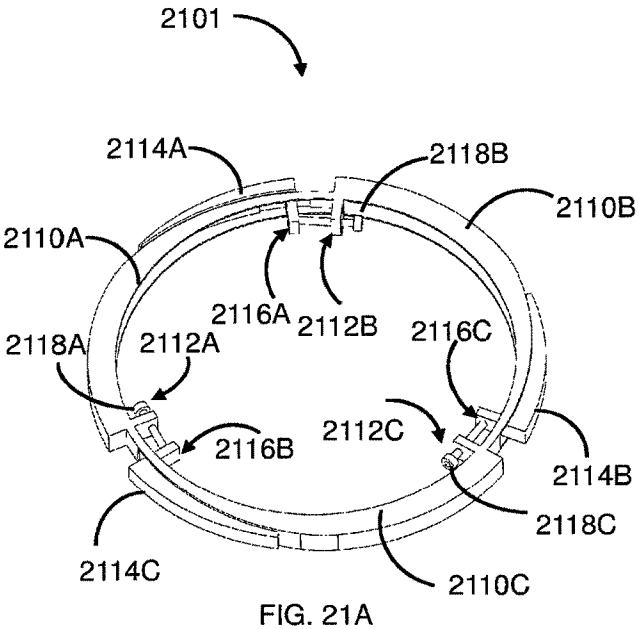
FIG. 21A is a schematic illustration of a pictorial view of a circular frame body having an adjustable diameter, according to some embodiments.

For instance, as exemplary shown in FIG. 21A. A diameter-variable static ring 2101 may comprise a plurality of arcuate static sections 2110 (e.g., arcuate sections 2110A-2110C) that are telescopically expandable/retractable relative to each other and securable in a selected position by using a securing mechanism 2112. Securing mechanisms 2112AB-2112BC and 2112CA may for example be operative to secure, respectively, arcuate sections 2210A and 2110B in a desired position, to secure arcuate sections 2110B and 2110C in a desired position, and to secure arcuate sections 2110C and 2110A in a desired position. In some other embodiments, arcuate sections 2110 may constitute elements of the static rim.

In some embodiments, the plurality of arcuate sections 2110A-C may be slidably coupled with each other by respective arcuate follower elements 2114A-C having an inner surface that slidably abuts against an outer surface of the respective arcuate sections 2110A-C for the arcuate follower elements. Each arcuate follower element 2114 has a follower pin 2116A-2116C that interlockingly engages with a slot portion of the shell section against which the arcuate follower element 2114. Each follower pin is interlockingly and slidably coupled with the neighboring arcuate follower element via the securing mechanism 2112 thereof comprising an adjustment bolt 2118 which also has an interlocking coupling function. In the example shown in FIG. 21A, the inner surface of first arcuate follower element 2114A slidably abuts against the outer surface of first arcuate section 2110A. First follower pin 2116A of first arcuate follower element 2114A is interlockingly and slidably coupled with arcuate section 2110B, which is in turn slidably coupled with arcuate section 2110C through second arcuate follower element 2114B. Generally, the arcuate follower element with its follower pin form a sickle-shaped coupling unit.

The inner surface of arcuate follower elements 2114 and the outer surface of arcuate section 2110 are wedge-shaped and have, relative to each other, oppositely expanding angles of inclinations. Thusly configured, telescopically forcing the arcuate sections 2110A-2110C towards each other allows to slidably decrease the inner shell's 2101 diameter. Conversely, telescopically forcing the arcuate sections 2110A-2110C away from each other slidably increases the diameter. The distance between the arcuate sections 2110A-2110C may be adjusted by rotating threaded adjustment bolts 2118A-2118C.

As exemplarily shown in FIG. 21B, a rotatable rim 2268 may be slidably mounted on or in a circular guiding track 2212. An automatic drive mechanism 2214 may be configured to selectively impart a clockwise or counterclockwise circular sliding force on the rotatable rim 2268 which, in turn, may rotate ramps 72 (cf. FIG. 10).

The automatic drive mechanism 2210 may, for example, include an electromechanical mechanism (e.g., a solenoid valve shown in FIG. 21B), a pneumatic mechanism and/or a hydraulic mechanism.

According to some embodiments, the diameter of an inner shell may be user-adjustable. Optionally, the principle of a so-called hose clamp may be employed, for varying the diameter and for securing the diameter of the inner shell to a desired magnitude. Optionally, a securing mechanism of for securing the diameter-adjustable inner shell circular strip in a certain diameter may comprise a teethed section (not shown) provided at one of the ends of the inner shell and a matching flexible-resilient tongue (not shown) at the other end of the inner shell. When the flexible-resilient tongue engages with a detent formed by two neighboring teeth, the relative position between the two ends is retained, unless sufficient force is imparted which bends the tongue and slidably dislocates over the teeth.

In some embodiments, the diameter adjustment mechanism may be removably operably mounted (e.g., in a "do-it-yourself" manner) to an existing drum, e.g., by using the diameter-adjustable static ring schematically and exemplarily shown in FIG. 21A. In some other embodiments, a drum may come with a diameter adjustment mechanism pre-installed to it.

Additional reference is made to FIG. 21C. In all embodiments, the diameter and height adjustment mechanism may be operated using a powered drive (e.g., motor operated), in which case they may optionally also be wirelessly controlled. A network interface (not shown) operably coupled with the powered drive may execute protocols employed by a Wireless Local Area Network (WLAN)), Bluetooth® (e.g., Bluetooth smart), ZigBee™, near-field communication (NFC) and/or any other current or future communication network, standard, and/or system. The powered drive may comprise or be operably coupled with a chargeable and/or non-chargeable power source.

For instance, as schematically shown in FIG. 21C, a powered drive of a powered diameter adjustment mechanism 2171 may be remotely operatable by the drummer, e.g., via a computerized client device (not shown). A computerized client device may include a multifunction mobile communication device, also known as "smartphone"; a laptop, a tablet computer, a desktop computer; a wearable device; and/or the like.

In manual mode, the dials 91 and 92 (or, analogously, dials 1414A and 1414B may be calibrated so that the drummer can select a preset frequency or tone. In wireless mode, this can be achieved automatically via a suitable controller (not shown).

Components, elements and devices described herein may be made of any suitable material including, for example, polymer material and/or metal.

Other variations will be apparent to those skilled in the art. The description of the above embodiments is therefore not intended to be limiting, the scope of protection being provided only by the appended claims.

It should also be noted that features that are described with reference to one or more embodiments are described by way of example rather than by way of limitation to those embodiments. Thus, unless stated otherwise or unless particular combinations are clearly inadmissible, optional features that are described with reference to only some embodiments are assumed to be likewise applicable to all other embodiments also.

In the discussion, unless otherwise stated, adjectives such as "substantially" and "about" that modify a condition or relationship characteristic of a feature or features of an embodiment of the invention, are to be understood to mean that the condition or characteristic is defined to within tolerances that are acceptable for operation of the embodiment for an application for which it is intended.

"Coupled with" means indirectly or directly "coupled with".

It is important to note that the method may include is not limited to those diagrams or to the corresponding descriptions. For example, the method may include additional or even fewer processes or operations in comparison to what is described herein. In addition, embodiments of the method are not necessarily limited to the chronological order as illustrated and described herein.

It should be understood that where the claims or specification refer to "a" or "an" element and/or feature, such reference is not to be construed as there being only one of that element. Hence, reference to "an element" or "at least one element" for instance may also encompass "one or more elements".

In the description and claims of the present application, each of the verbs, "comprise" "include" and "have", and conjugates thereof, are used to indicate that the object or objects of the verb are not necessarily a complete listing of components, elements or parts of the subject or subjects of the verb.

As used herein the term "configuring" and/or 'adapting' for an objective, or a variation thereof, implies using materials and/or components in a manner designed for and/or implemented and/or operable or operative to achieve the objective.

Unless otherwise stated, the use of the expression "and/or" between the last two members of a list of options for selection indicates that a selection of one or more of the listed options is appropriate and may be made, and may be used interchangeably with the expressions "at least one of the following", "any one of the following" or "one or more of the following", followed by a listing of the various options.

As used herein, unless otherwise specified, the use of the ordinal adjectives "first", "second", etc., to describe like objects, merely indicate that different instances of like objects are being referred to, and are not intended to imply that the objects so described must be in a given sequence, temporally, in ranking, and/or in any other manner.

It should be appreciated that certain features, structures, characteristics, stages, methods, modules, elements, entities or systems disclosed herein, which are, for clarity, described in the context of separate examples, may also be provided in combination in a single example. Conversely, various features, structures, characteristics, stages, methods, modules, elements, entities or systems disclosed herein, which are, for brevity, described in the context of a single example, may also be provided separately or in any suitable sub-combination.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is noted that the term "exemplary" is used herein to refer to examples of embodiments and/or implementations, and is not meant to necessarily convey a more-desirable use-case.

While the invention has been described with respect to a limited number of embodiments, these should not be construed as limitations on the scope of the invention, but rather as exemplifications of some of the embodiments.

The invention claimed is:

1. An apparatus for tuning a drum, the drum comprising a drum shell having an upper skin, the apparatus comprising:

an static rim that is removably coupleable to the drum shell;

a diameter adjustment mechanism that is removably coupleable to the static rim, wherein the diameter adjustment mechanism is mountable within the drum shell and being configured for axial displacement wherein an upper rim thereof can be selectively brought into or out of contact with the upper skin and thereby change an effective diameter of the upper skin.

2. The apparatus of claim 1, wherein the diameter adjustment mechanism comprises one or more inner cylindrical shells.

3. A tunable drum comprising:

an outer cylindrical shell defining a hollow housing having opposing open lower and upper ends, a lower and upper skin each covering a respective one of the lower and upper ends, and a diameter adjustment mechanism fixedly attached to the outer cylindrical shell and positioned inside the hollow housing, wherein the diameter adjustment mechanism is configured for axial displacement and wherein at least one upper rim thereof may be brought into or out of contact with the upper skin and thereby change an effective diameter of the upper skin.

4. The drum according to claim 3, wherein the diameter adjustment mechanism comprises:

at least one inner cylindrical shell provided with the upper rim;

a circular base supporting at least one ramp for each inner cylindrical shell, the ramp being rotatable relative to the outer cylindrical shell of the drum and being dimensioned such that when a lower rim of the respective inner cylindrical shell is supported at an upper end of the ramp, the upper rim abuts the upper skin and when the lower rim of the respective inner cylindrical shell is supported at a lower end of the ramp, the upper rim is clear of the upper skin, a linear bevel gear mounted toward a periphery of the circular base, and a pinion gear rotatably mounted toward the lower end of the cylindrical shell for engaging the linear bevel gear;

wherein rotation of the pinion gear in a first direction rotates the circular base in a first direction and causes the ramp to push the inner cylindrical shell upward, while rotation of the pinion gear in a second opposite direction rotates the base in a second opposite direction, thereby lowering the ramp and allowing the inner cylindrical shell to fall clear of the upper skin.

5. The drum according to claim 4, wherein the circular base supports at least two radially displaced ramps mounted in anti-phase and each supporting a respective inner cylindrical shell.

6. The drum according to claim 4, wherein each of the ramps comprises a longitudinal slot through there is mounted a sliding coupler bolt having a lower end and an upper end, the upper end being configured for coupling to the respective inner cylindrical shell and the lower end supporting a mechanical energy storage device abutting a lower surface of the ramp so as to urge the coupler bolt toward the lower end of the ramp.

7. The drum according to claim 6, wherein the upper end of the coupler bolt is attached to a key that engages a slot in a lower periphery of the inner cylindrical shell.

8. The drum according to claim 4, wherein the pinion gear is operated by a lever having a releasable stopper that rotates relative to a dial having a projecting edge that arrests further rotation of the lever.

9. The drum according to claim 8, wherein the dial is rotatable by a worm gear so that the height of the upper rim is finely adjustable and predictable.

10. The drum according to claim 3, wherein the upper rims are parallel to the upper skin so that the diameter adjustment mechanism is uniformly raised so that each point on the upper rim comes simultaneously into contact with the skin.

11. A drum comprising an outer cylindrical shell that includes an upper shell and a lower shell that are mutually axially displaceable so as to change an effective height of the cylindrical shell, a lower end of the lower shell constituting the lower end of the outer cylindrical shell.

12. The drum according to claim 11, wherein at least one of the upper shell and the lower shell is coupled to a height adjustment mechanism operable to axially displace the upper shell and the lower shell.

13. The drum according to claim 11, wherein a height adjustment mechanism is provided for axially displacing the one of the upper shell and the lower shell relative to a seal shell intermediate the upper shell and the lower shell.

14. The drum according to claim 13, wherein the height adjustment mechanism includes one or more hinges articulated to the upper shell and the lower shell, each of the hinges comprising:

a respective upper and lower link having mutually proximate and opposing ends, the opposing ends being hingedly anchored proximate an upper edge of the upper shell and a lower edge of the lower shell, respectively, and the proximate ends being commonly hinged to the seal shell;

whereby rotation of one of the upper shell and the lower shell relative to the seal shell in a first direction closes the hinges and reduces the height of the drum while rotation of the one of the upper shell and the lower shell relative to the seal shell in a second opposite direction opens the hinges and increases the height of the drum.

15. The drum according to claim 13, wherein the height adjustment mechanism includes a linear bevel gear and pinion gear respectively fixed to the one of the upper shell and the lower shell and to the intermediate seal shell or vice versa.

16. The drum according to claim 3, wherein the diameter adjustment mechanism comprises one or more inner cylindrical shells.

17. The drum according to claim 11, wherein the drum is tunable.

* * * * *